US006287000B1

(12) United States Patent
Buchman

(10) Patent No.: US 6,287,000 B1
(45) Date of Patent: Sep. 11, 2001

(54) RESEALABLE PACKAGE HAVING ZIPPER CLOSURE WITH TAMPER EVIDENT SEAL, INCLUDING A SLIDER DEVICE HAVING A SEAL CUTTING MECHANISM

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/564,628

(22) Filed: May 4, 2000

Related U.S. Application Data

(60) Provisional application No. 60/134,280, filed on May 14, 1999.

(51) Int. Cl.[7] ..... B65D 33/34

(52) U.S. Cl. ..... 383/5; 383/64; 383/202; 383/203; 24/399

(58) Field of Search ..... 383/5, 61, 64, 383/202, 203, 204; 24/399, 400

(56) References Cited

U.S. PATENT DOCUMENTS 2,994,469 * 8/1961 Troup et al. ..... 383/64 X
5,167,608 * 12/1992 Steffens, Jr. et al. ..... 383/202 X
5,211,482 * 5/1993 Tilman ..... 383/202
5,669,715 9/1997 Dobreski et al. .
5,911,508 * 6/1999 Dobreski et al. ..... 383/5
5,964,532 * 10/1999 St. Phillips et al. ..... 383/5

FOREIGN PATENT DOCUMENTS

0485741 * 5/1992 (EP) ..... 383/61
093011051 * 6/1993 (WO) ..... 383/202

* cited by examiner

*Primary Examiner*—Jes F. Pascua

(57) ABSTRACT

A flexible package includes a recloseable zipper along the mouth of the package for selective opening and closing of the mouth. The zipper includes first and second closure profiles, which are configured and constructed to selectively interlock. A tamper evident seal is provided, attached to both the first and second closure members to indicate whether or not the seal on the package has been damaged. A slider device is configured and constructed to facilitate the mating (closing) and unmating (opening) of the zipper, and to open the tamper evident seal to provide access to the package interior.

13 Claims, 4 Drawing Sheets

RESEALABLE PACKAGE HAVING ZIPPER CLOSURE WITH TAMPER EVIDENT SEAL, INCLUDING A SLIDER DEVICE HAVING A SEAL CUTTING MECHANISM

This application claims the benefit of U.S. Provisional Application No. 60/134,280, filed May 14, 1999.

FIELD OF THE DISCLOSURE

The present disclosure generally relates to closure arrangements for packages. In particular, the present disclosure relates to closure arrangements having recloseable profiles and slider devices to open and close the profiles.

BACKGROUND

Many packaging applications use resealable containers to store various types of articles and materials. These packages may be used to store and ship food products, non-food consumer goods, medical supplies, waste materials, and many other articles. Slider devices have been used to help open and close closure profiles on recloseable and/or resealable bags and other packages.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Some perishable goods are sold to consumers packaged in a recloseable bag or package. For example, cheese, meat or vegetable products can be packaged in a bag with recloseable closure profiles so that after opening the package and removing some of the product, the package can be re-closed. Often these packages include tamper evident features to notify the consumer whether the package previously has been opened. Due to the construction of these packages with recloseable closure profiles, it has been difficult to place tamper evident features on a bag or package that includes a slider device to help open and close the recloseable closure profiles.

Improvements in packaging, that includes tamper evident features and easily recloseable seals, are desirable.

SUMMARY OF THE DISCLOSURE

The present disclosure relates to a package, such as a flexible bag, having a combination of a resealable, recloseable zipper closure mechanism and a tamper evident seal. The tamper evident seal is attached to each half of the zipper mechanism (i.e., the second profile member and the first profile member). Opening and closing of the zipper closure mechanism is accomplished by a slider device mounted on the zipper closure mechanism. The slider device facilitates mating and unmating of the first and second profile members of the zipper closure. Access to the interior of the package cannot be gained until the zipper closure has been opened and the tamper evident seal has been breached, which is accomplished by a cutting mechanism on the slider device.

In particular, the present invention relates to a package comprising a package enclosure having at least two sides defining a package interior, and a mouth, the mouth providing access to the package interior. A recloseable zipper closure having first and second closure profiles extending along the mouth selectively opens and closes the mouth. Typically, the first and second closure profiles have engageable first and second closure profile members. A tamper evident seal is attached to both the first closure member and to the second closure member, so as to seal access to the engageable closure profile members and thus the package interior. The slider device, in addition to being configured and constructed to selectively open and close the mouth, has a mechanism or device configured and constructed to open the tamper evident seal; this device may be a cutting device that slits or punctures the tamper evident seal. A method of opening a package is also provided.

DETAILED DESCRIPTION

Figure 1:
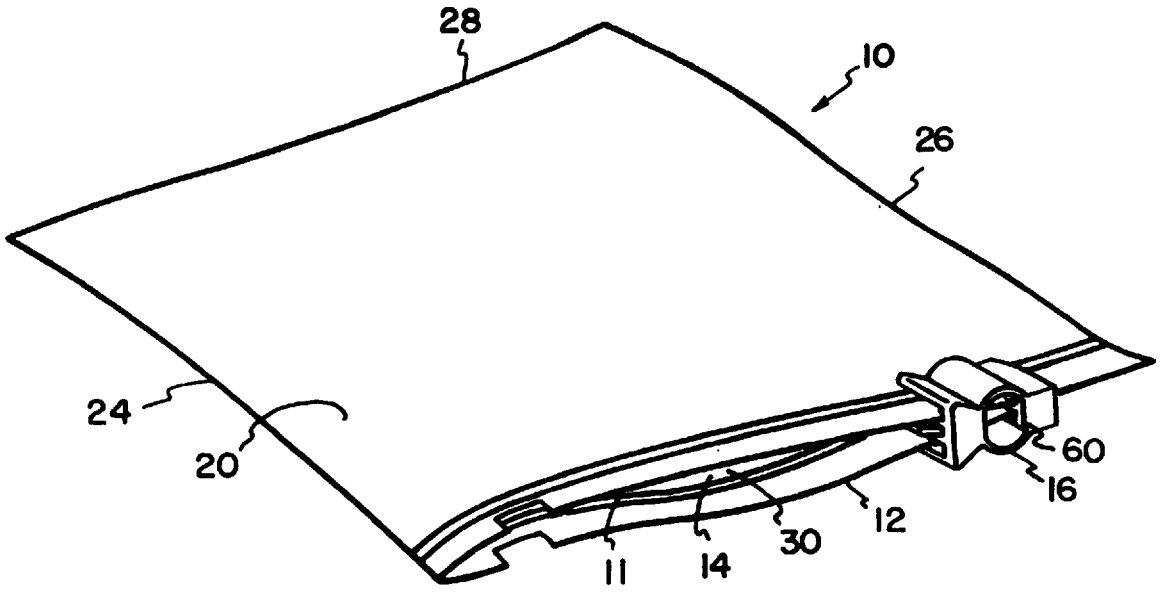
FIG. 1 is a perspective view of a conventional flexible, recloseable package.

Attention is directed to FIG. 1, which illustrates an example of a packaging arrangement in the form of a resealable, flexible package 10 having a zipper closure 11 with first and second closure profiles 12, 14 and a slider device 16 mounted on the zipper closure 11 to open and close (umnate and mate) the profiles 12, 14.

The flexible package 10 includes an enclosure or surrounding wall comprising first panel section 20 and a second opposed panel section (not shown), each made from a flexible, polymeric film. For some manufacturing applications, the first panel section 20 and second panel section meet and are heat-sealed together along two edges 24, 26; the panel sections additionally meet at a fold line in order to form a three-edged containment section for a product within the interior of the package 10. The fold line comprises the bottom edge 28. Alternatively, two separate panel sections of polymeric film may be used and heat-sealed together along the two edges 24, 26 and at the bottom edge 28. Access is provided to the interior of the package 10 through a mouth 30. Zipper closure 11 defines mouth 30.

The zipper closure 11 can include a variety of configurations and structures. For example, the zipper closure 11 can be constructed according to U.S. Pat. Nos. 4,240,241; 4,246,288; or 4,437,293; each of which is incorporated by reference herein.

Figure 2:
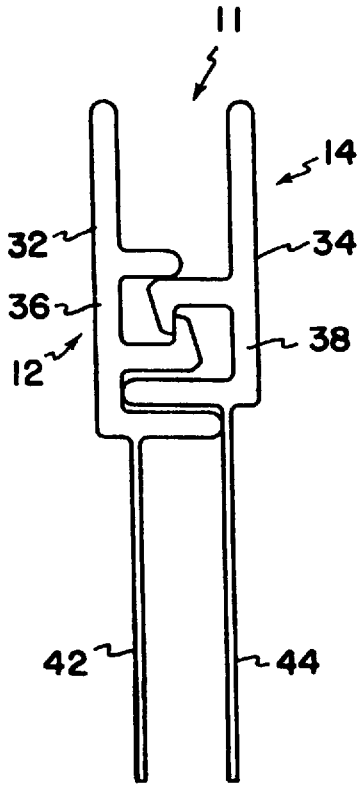
FIG. 2 is a schematic, cross-sectional view of a conventional zipper closure arrangement similar to that depicted in the package of FIG. 1.

In the particular zipper shown in FIG. 2, the zipper closure 11 has first and second closure profiles 12, 14 in the form of a first profile member 32 and second profile member 34. The first profile member 32 has a first depending fin or flange 42 extending from a first profile member element 36, and the second profile member 34 has a second depending fin or flange 44 extending from a second profile member element 38. If the zipper closure 11 is formed separately from the panel sections, the first and second fins 42, 44 are typically thermally fused to inner surfaces of the respective first and second panel sections. Alternatively, the zipper closure 11 may be extruded with the panel sections so that the first fin 42 is integrally formed with the first panel section 20, and the second fin 44 is integrally formed with the second panel section.

Referring again to FIG. 1, slider device 16, mounted on zipper closure 11, opens and closes first and second closure profiles 12, 14. When slid in a first direction, slider device 16 closes closure profiles 12, 14 by pressing the two profiles 12, 14, in particular, first profile member 32 and second profile member 34 (illustrated in FIG. 2), together so that they engage and mesh, providing a seal. When slid in an opposite, second direction, slider device 16 opens profiles 12, 14 by providing a wedge between the two profiles 12, 14. First and second closure profiles 12, 14 can then be spread apart to provide access to the bag interior through bag mouth 30.

In accordance with certain principles of this disclosure, a tamper evident seal is provided over and connected to first and second closure profiles 12, 14, to provide evidence whether or not the reclosable zipper closure 11 has been previously opened. The tamper evident seal is provided on the zipper closure 11 opposite the side of the side panels that define the interior of the package. By "tamper evident", it is meant that an attempt to breach the integrity of the seal is evidenced or shown by a distortion, damaging, or destruction of the seal.

Figure 4:
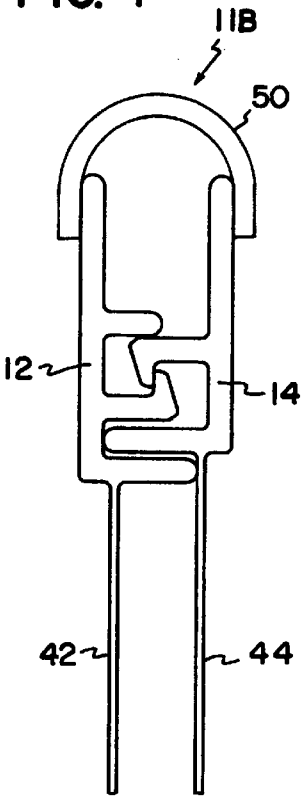
FIG. 4 is a schematic, cross-sectional view of another embodiment of a zipper closure arrangement having a tamper evident seal, according to the principles of this invention.
Figure 3:
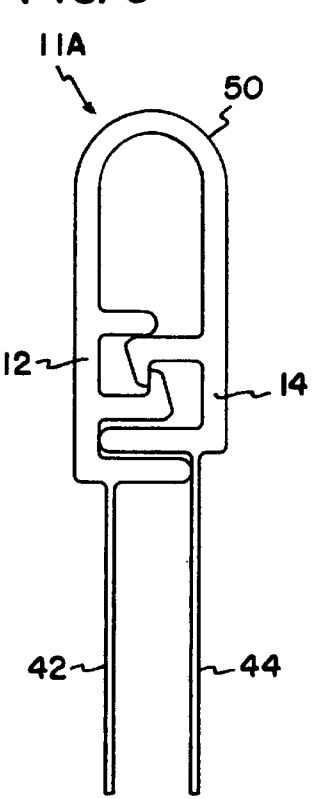
FIG. 3 is a schematic, cross-sectional view of a zipper closure arrangement of the present invention having a tamper evident seal, according to the principles of this invention.

FIGS. 3 and 4 illustrate examples of zipper closures 11A, 11B having a tamper evident seal 50 sealed to first and second closure profiles 12, 14. It will be appreciated that when tamper evident seal 50 is undisturbed (that is, seal 50 has not been broken or breached and is intact), first and second closure profiles 12, 14 cannot be spread apart in order to provide access to the package interior.

In each of zipper closures 11A, 11B, tamper evident seal 50 extends from first closure profile 12 to second closure profile 14 and provides a seal that does not allow opening of package 10 at that closure point; specifically, tamper evident seal 50 does not allow unmating and spreading of first and second closure profiles 12, 14. In some instances, it may be possible to release first closure profile 12 from second closure profile 14 (i.e., open or unzip the zipper closure 11), however, tamper evident seal 50 would remain intact and retain the security of the contents of the package 10 by not permitting package 10 to be opened and access gained to the interior. Preferably, tamper evident seal 50 extends the entire width of package 10; that is, from one edge 24 to the other edge 26 (FIG. 1).

Tamper evident seal 50 may be made from any material that is sufficiently flexible to move with flexible package 10. Tamper evident seal 50 may be made from materials such as metal (for example, aluminum foil), paper, or cloth, but is preferably made from an extruded polymeric material, often from the same material as the first and second closure profiles 12, 14.

Figure 5:
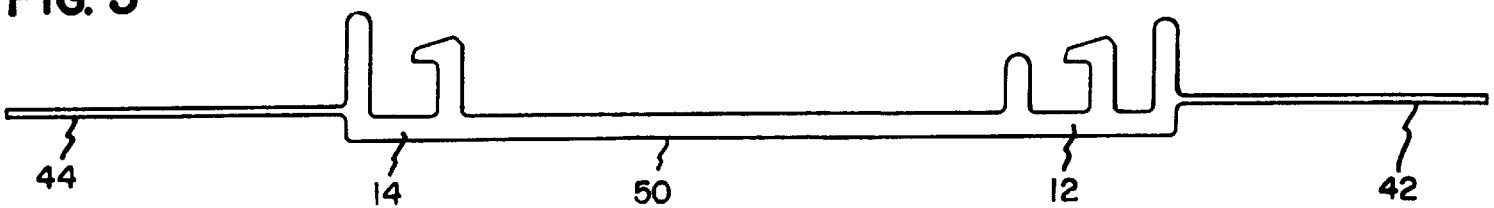
FIG. 5 is a schematic, cross-sectional view of the zipper closure arrangement depicted in FIG. 3, prior to configuration and attachment to a package.

Tamper evident seal 50 can be attached to closure profiles 12, 14 by any method that provides a permanent adherence of tamper evident seal 50 to first and second closure profiles 12, 14. If tamper evident seal 50 is made from a polymeric material, the polymeric piece that results in tamper evident seal 50 may be formed integral with first and second closure profiles 12, 14, such as shown in FIG. 3. For zipper closure 11 A, tamper evident seal 50 is a continuous extension from each of closure profiles 12, 14. To form such a continuous piece, a single shaped film having first closure profile 12, first fin 42, second closure profile 14, second fin 44, and tamper evident seal 50, as shown in FIG. 5, is extruded. This piece is then folded to properly position first and second closure profiles 12, 14 for engagement, connected by tamper evident seal 50. The first and second fins 42, 44 are thermally fused to the respective first and second panel sections, typically to the inner surfaces of the panel sections.

In another embodiment, shown in FIG. 4 as zipper closure 11B, a polymeric film or membrane is applied over the distal ends or tips of closure profiles 12, 14 after the profiles have been formed and, optionally, joined together. The polymeric film is attached to closure profiles 12, 14 to form a tamper evident seal 50, such as shown in FIG. 4. The polymeric film piece that forms tamper evident seal 50 can be attached to closure profiles 12, 14 with an adhesive or, preferably, the tamper evident seal 50 is thermally fused to closure profiles 12, 14.

Tamper evident seal 50, no matter how constructed or applied, should provide a permanent seal between first and second closure profiles 12, 14 so that any tampering, vandalism, mutilation, or the like of the zipper closure 11 or mouth 30 is readily discernible.

Figure 6:
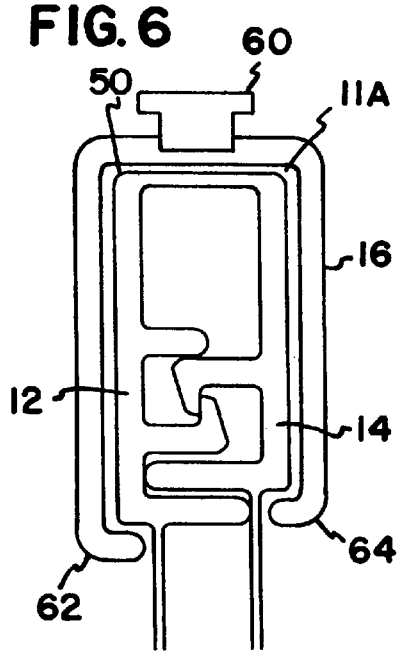
FIG. 6 is an enlarged, schematic, cross-sectional view of a zipper closure arrangement having a slider device mounted thereon, the slider device having a seal cutting device in a first retracted position, according to the principles of this invention.

FIG. 6 illustrates zipper closure 11A from FIG. 3 having a slider device 16 mounted thereon. Slider device 16 has a first arm 62 and a second arm 64 that engage over first closure profile 12 and second closure profile 14, respectively. Slider device 16 functions by facilitating the mating (closing) and unnating (opening) of zipper closure 11, and is typically made from a molded plastic material. When slider device 16 is slid in a first direction along zipper closure 11, slider device 16 closes profiles 12, 14 by pressing the two profiles 12, 14, in particular, first profile member 32 and second profile member 34 (illustrated in FIG. 2) together so that they mate, providing a seal. When slider device 16 is slid in the opposite second direction, slider device 16 opens profiles 12, 14 by providing a wedge between the two profiles 12, 14. First and second closure profiles 12, 14 can then be spread apart to provide access to the bag interior through bag mouth 30 Conventional slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent applications Ser. No. 09/365,215 and 29/108,657, both filed Jul. 30, 1999 and incorporated herein by reference in their entirety.

Slider device 16, according to the principles of this invention, mounts on first and second closure profiles 12, 14 and is configured and constructed to open and close the profiles in generally the same manner as conventional slider devices. Slider device 16 includes a seal cutting device 60, which is unique to the slider device of the present invention.

Figure 7:
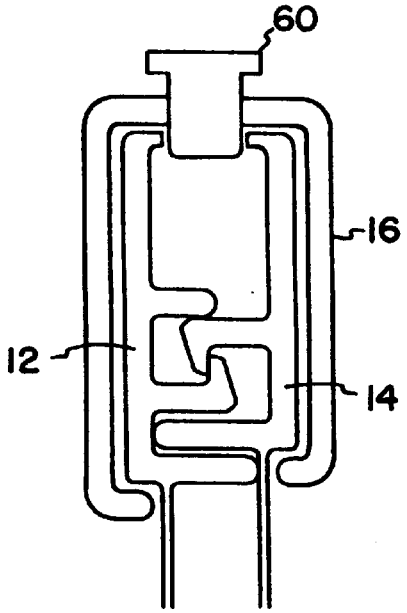
FIG. 7 is an enlarged, schematic, cross-sectional view of a zipper closure arrangement having a slider device mounted thereon, the slider device having a seal cutting device in a second extended position, according to the principles of this invention.

When flexible package 10, having zipper closure 11 with tamper evident seal 50, is ready to be opened by the purchaser of the package, cutting device 60 on slider device 16 is activated; that is, cutting device 60 is moved from a first position to a second position, so that cutting device 60 cuts, slits, tears, or otherwise opens tamper evident seal 50. By the term "open", any action such as slitting, puncturing, cutting, slicing, perforating, tearing, ripping, and the like, which breaks tamper evident seal 50 and allows access to the interior of the package, is intended. FIG. 6 shows cutting device 60 in a first position, spaced away from tamper evident seal 50. FIG. 7 shows cutting device 60 in a second depressed position, with tamper evident seal 50 having been breached by cutting device 60.

Figure 8:
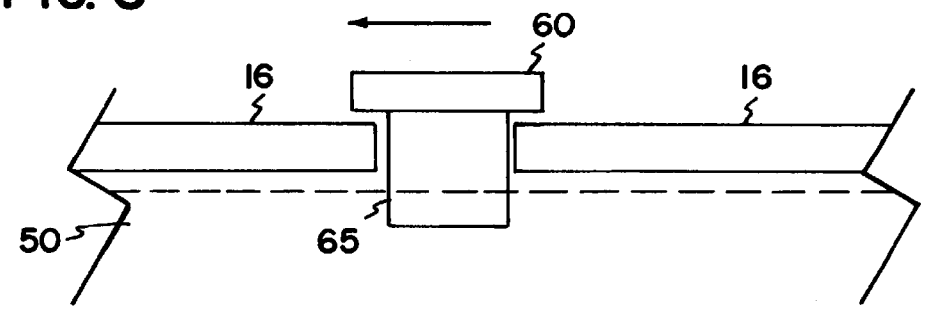
FIG. 8 is an enlarged, schematic, cross-sectional side view of one embodiment of a seal cutting device, shown in the second extended position, according to the principles of this invention.
Figure 9:
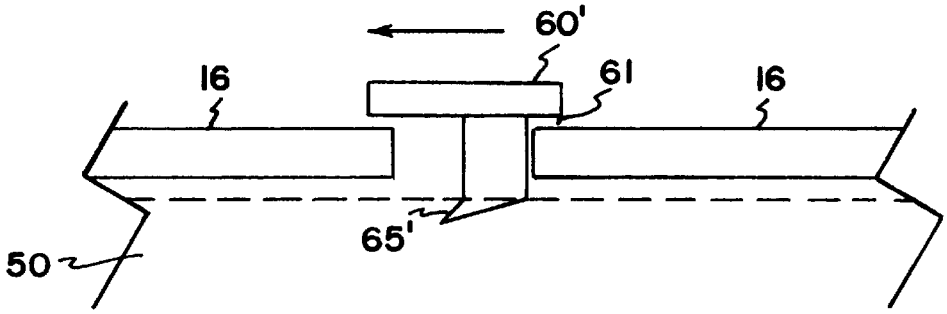
FIG. 9 is an enlarged, schematic, cross-sectional side view of another embodiment of a seal cutting device, shown in the second extended position, according to the principles of this invention.
Figure 10:
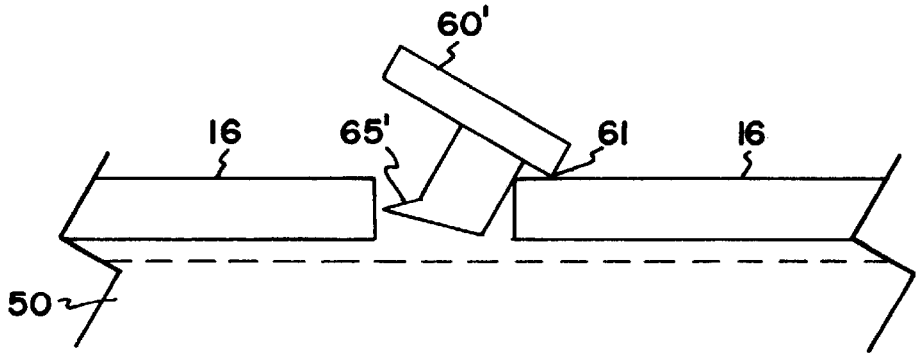
FIG. 10 is an enlarged, schematic, cross-sectional side view of the seal cutting device depicted in FIG. 9, shown in the first retracted position, according to the principles of this invention.

Cutting device 60 is an extendible, and optionally, a retractable feature that is capable of opening tamper evident seal 50. Cutting device 60 may be a pin, nail, wedge, blade, or any such item. Cutting device 60 may be completely removable from slider device 16 or may be permanently attached to slider device 16. A cutting edge 65, such as shown in FIG. 8, may be present on cutting device 60. Cutting edge 65 is typically a sharp edge adapted to easily slice through or otherwise breach tamper evident seal 50. Edge 65 can be made from the same material as cutting device 60 or slider device 16, or can include a material such as a piece of metal, ceramic, glass, or the like that is attached to cutting device 60. In some embodiments, cutting edge 65 is angled or tapered, to facilitate cutting of tamper evident seal 50. FIG. 8 schematically depicts a cross-sectional view of a first embodiment of cutting device 60 within slider device 16, shown in enlarged side view, and FIGS. 9 and 10 schematically depict a second embodiment of cutting device 60' within slider device 16. In FIGS. 8 and 9, cutting devices 60, 60' are depressed to the second position so that a portion of cutting device 60, 60' extends through the top wall of slider device 16 with at least a portion of cutting device 60, 60' extending down to contact tamper evident seal 50 (shown in phantom in FIGS. 8–10). The arrows indicate the direction of movement of slider device 16; thus cutting edge 65, 65' is the leading edge of cutting device 60, 60' as cutting device 60, 60' slides from right to left and opens tamper evident seal 50. In some embodiments, it may be desired to have a cutting edge 65, 65' on both sides of cutting device 60, 60' so that tamper evident seal 50 can be opened by either direction of travel of slider device 16.

Cutting device 60 can include metal, plastic, or any other suitable material; preferably, cutting device 60 is molded from a plastic material, such as the same plastic used to mold slider device 16. In some embodiments, cutting device 60 is molded simultaneously with slider device 16. Cutting device 60 may be molded to be integral with slider device 16; that is, slider device 16 and cutting device 60 are together as the same item or piece.

If cutting device 60 is molded integral with slider device 16, cutting device 60 may be attached to slider device 16 by a living hinge, which allows pivotal motion of cutting device 60 in relation to slider device 16. FIGS. 9 and 10 illustrate cutting device 60' in pivotal relation to slider device 16 at living hinge 61. Cutting device 60' is shaped and sized so that when cutting device 60' is in the first, undepressed or retracted position shown in FIG. 10, cutting edge 65' is raised above tamper evident seal 50 and tamper evident seal 50 is intact. When cutting device 60' is pivoted to the second, depressed or extended position as shown in FIG. 9, cutting device 60' and cutting edge 65' extend below the level of tamper evident seal 50, so that upon contact of seal 50 with cutting edge 65', tamper evident seal 50 is breached and opened.

When tamper evident seal 50 has been opened, access can be gained to the closure profiles 12, 14 and to the interior of package 10. When tamper evident seal 50 has been opened, cutting device 60 may be left in the depressed position or may be retracted to its original position. Cutting device 60 can be designed so that once depressed, cutting device 60 is locked into that extended position. In another embodiment, cutting device 60 can be designed to be removed from slider device 16 and discarded.

The above specification and examples are believed to provide a complete description of the manufacture and use of particular embodiments of the disclosure. Many embodiments of the disclosure can be made without departing from the spirit and scope of the disclosure.

I claim:

1. A package comprising:

(a) a package surrounding wall having a side edge and a mouth therebetween; said mouth providing access to a package interior;

(b) a reclosable zipper along said mouth for selective opening and closing of said mouth; said zipper including first and second closure profiles;

(i) said first and second closure profiles configured and constructed to selectively interlock;

(c) a tamper evident seal connecting said first closure profile to said second closure profile; and (d) a slider device configured and constructed to selectively open and close said mouth;

(i) said slider device having a cutting device configured and constructed to open said tamper evident seal;

(ii) said cutting device being moveable from a first position to a second position, wherein when in the first position, said cutting device is spaced away from said tamper evident seal and, when in the second position, said cutting device contacts said tamper evident seal;

(iii) said slider device comprises a hinge to allow pivotal movement of said cutting device in relation to said slider device;

(iv) wherein said hinge is a living hinge.

2. A package according to claim 1, wherein said cutting device comprises plastic material.

3. A package according to claim 1, wherein:

(a) said cutting device comprises a cutting edge, which when said cutting device is in the second position, said cutting edge contact said tamper evident seal.

4. A package according to claim 3, wherein said cutting device and said cutting edge comprise plastic material.

5. A package according to claim 4, wherein said cutting device is integral with said slider device.

6. A package according to claim 1, wherein said tamper evident seal is a continuous extension from said first closure profile to said second closure profile.

7. A package according to claim 1, wherein said tamper evident seal comprises a membrane attached to each of said first closure profile and said second closure profile.

8. A zipper closure for incorporation into a reclosable package along a mouth of the package, said zipper closure comprising:

(a) a first closure profile and a second closure profile, constructed to engage and disengage;

(b) a tamper evident seal connecting said first closure profile to said second closure profile;

(c) a slider device operably mounted on said first closure profile and said second closure profile, said slider device constructed and arranged to engage said first closure profile with said second closure profile when said slider device is moved in a first direction, and to disengage said first closure profile from said second closure profile when said slider device is moved in a second opposite direction;

(i) said slider device having a cutting device having a first position and a second position, said cutting device penetrating said tamper evident seal when in said second position;

(ii) wherein said cutting device is pivotally attached to said slider device.

9. A zipper closure according to claim 8, wherein:

(a) said tamper evident seal comprises a membrane attached to each of said first closure profile and said second closure profile.

10. A zipper closure according to claim 8, wherein:

(a) said cutting device is integral with said slider device.

11. A zipper closure for incorporation into a reclosable package along a mouth of the package, said zipper closure comprising:

(a) a first closure profile and a second closure profile, constructed to engage and disengage;

(b) a tamper evident seal connecting said first closure profile to said second closure profile;

(c) a slider device operably mounted on said first closure profile and said second closure profile, said slider device constructed and arranged to engage said first closure profile with said second closure profile when said slider device is moved in a first direction, and to disengage said first closure profile from said second closure profile when said slider device is moved in a second opposite direction;

(i) said slider device having a cutting device having a first position and a second position, said cutting device penetrating said tamper evident seal when in said second position;

(ii) wherein said cutting device and said slider device have a hinge therebetween.

12. A zipper closure according to claim 11, wherein:

(a) said tamper evident seal comprises a membrane attached to each of said first closure profile and said second closure profile.

13. A zipper closure according to claim 11, wherein:

(a) said cutting device is integral with said slider device.

* * * * *